US009435058B2

(12) United States Patent
Dias et al.

(10) Patent No.: US 9,435,058 B2
(45) Date of Patent: Sep. 6, 2016

(54) LINEAR ELECTRONIC TRANSDUCER

(71) Applicants: Tilak Dias, Stockport (GB); William Hurley, Stockport (GB)

(72) Inventors: Tilak Dias, Stockport (GB); William Hurley, Stockport (GB)

( * ) Notice: Subject to any disclaimer, the term of this patent is extended or adjusted under 35 U.S.C. 154(b) by 0 days.

(21) Appl. No.: 14/605,820

(22) Filed: Feb. 11, 2015

(65) Prior Publication Data

US 2015/0275406 A1 Oct. 1, 2015

Related U.S. Application Data

(63) Continuation of application No. 12/864,308, filed as application No. PCT/GB2009/000195 on Jan. 26, 2009, now Pat. No. 8,966,942.

(30) Foreign Application Priority Data

Jan. 25, 2008 (GB) ..... 0801425.0

(51) Int. Cl.
*D04B 1/14* (2006.01)
*D04B 1/24* (2006.01)

(52) U.S. Cl.
CPC . *D04B 1/14* (2013.01); *D04B 1/24* (2013.01); *D10B 2403/02431* (2013.01)

(58) Field of Classification Search
CPC ..... D04B 1/14; D04B 1/24
USPC ..... 66/169 R, 170, 172 E, 202, 171
See application file for complete search history.

(56) References Cited

U.S. PATENT DOCUMENTS 6,047,203 A * 4/2000 Sackner ..... A61D 13/1281 600/301
6,341,504 B1 * 1/2002 Istook ..... A61B 5/0002 2/69
6,970,731 B1 * 11/2005 Jayaraman ..... A61B 5/0008 600/388
7,337,012 B2 * 2/2008 Maghribi ..... A61N 1/05 600/393
7,559,902 B2 * 7/2009 Ting ..... A61B 5/0408 600/300
7,871,661 B2 * 1/2011 Maghribi ..... A61N 1/0551 427/171
7,878,030 B2 * 2/2011 Burr ..... D04B 1/14 66/173
8,034,001 B2 * 10/2011 Gal ..... A61B 5/1135 600/534
2003/0186607 A1 * 10/2003 Goldberg ..... A61N 1/0408 442/304
2006/0281382 A1 * 12/2006 Karayianni ..... D03D 1/0088 442/181
2007/0083096 A1 * 4/2007 Paradiso ..... A61B 5/0408 600/388
2007/0089800 A1 * 4/2007 Sharma ..... D02G 3/441 139/388
2007/0298666 A1 * 12/2007 Kurth ..... D04B 1/14 442/1
2009/0018428 A1 * 1/2009 Dias ..... A41D 13/1281 600/388

* cited by examiner

*Primary Examiner* — Danny Worrell
(74) *Attorney, Agent, or Firm* — Adam Warwick Bell; Matthew Rupert Kaser

(57) ABSTRACT

An electronic transducer comprises a knitted structure extendible in two dimensions defined by its courses and wales.

12 Claims, 3 Drawing Sheets

LINEAR ELECTRONIC TRANSDUCER

This invention relates to electronic transducers, and particularly to such transducers incorporated into a knitted structure. Such knitted transducer devices are disclosed in International Patent Publication No: WO 2004/100 784, the disclosure whereof is hereby incorporated by reference. The device disclosed in this publication comprises a knitted structure having at least one transduction zone knitted with electrically conductive fibres. Deformation of the knitted structure results in a variation of an electrical property of the transduction zone. By monitoring these variations, it is possible to obtain an indication of deformation of the knitted structure. When incorporated into a garment, particularly one worn close to the skin, bodily movements can be monitored.

The present invention is also directed at electronic transducers comprising knitted structures. However, transducers of the invention focus on individual yarns in the structure, and specifically changes in an electrical characteristic of one or more knitted courses as a consequence of the structure being extended or stretched. According to the invention the transducer comprises a knitted structure of stitches arranged in courses, extendible in two dimensions defined by the courses and wales to distort the geometry of the stitches. Extension in the course dimension separates the legs of the stitches; extension in the wale dimension urges the legs of the stitches together. At least one electro-conductive yarn defines a single course in the knitted structure, which is otherwise created from non-conductive yarns, to form a single electrically conductive course of stitches with electrically non-conductive adjacent stitches. The course may be part of a circuit that provides an indication of an electrical characteristic of the course. The structure will have a relaxed or unextended condition, in which successive loops of the stitches including the electro-conductive yarn will be in engagement. With such engagement alternate stitches of the electrically conductive yarn are short circuited, and the resistance or other characteristic of the electro-conductive yarn course will reflect this. While the characteristic is typically resistance, it might be piezoelectric, capacitive or inductive. This enables the creation of localised linear transducer within a knitted fabric structure.

When a structure embodying the invention is extended or stretched in the course direction the touching loops of the electro-conductive yarn or yarns disengage and separate, thereby breaking the short-circuits between them and altering its or their electrical characteristics. When the structure is stretched or extended in the wale direction, the loops remain in engagement and the extent of contact is increased. This will also alter the electrical characteristics of the yarn or yarns. For example, the electrical resistance of the yarn or yarns will increase upon the structure being stretched or extended in the course direction to disengage or separate adjacent loops. It will remain unaltered, or reduce in response to stretching or extension in the wale direction. In this sense then, such a fabric can function as a two-way stitch.

The non-conductive yarns in knitted structures forming transducers according to the invention are normally low modulus yarns, typically elastomeric in order to enhance the performance characteristics of the linear transducer. When knitting structures with such yarns, they will normally be substantially stretched with the consequence that in the resultant structure the stitches are contracted such that successive loops along a course of stitches are in engagement or jammed. This will draw successive loops of the conductive yarn also into engagement, with the consequences outlined above.

If the non-conductive yarns of the knitted structure are non-extendible, then the structure can be formed more loosely, and the engagement or otherwise of successive loops in the conductive yarn determined positively by the extension of the structure in one or other of the course and wale dimensions. Such a structure, or that described above comprising elastomeric yarns, could be integrated in a square, rectangular or shaped knitted panel frame in which movement of opposite sides towards and away from each other determines whether the successive loops are in engagement.

Transducers of the invention will of course be used in combination with electrical circuitry for monitoring changes in the electrical characteristic of the electro-conductive yarn. The electrical circuitry can include a display and/or a memory for keeping a record of the monitored changes. As noted above, the electrical characteristic will typically be electrical resistance, but other characteristics can also be monitored, particularly if the knitted structure includes electro-conductive yarns in yarn courses spaced from one another, extensions in each of the course and wale direction can be very accurately monitored.

Transducers embodying the invention can be incorporated in garments such as training vests which are used to monitor body or respiratory movements. Another particular garment in which the transducer can be useful is a belt or strap which can be used to focus on a particular area or region of the body.

The invention will now be further described by way of example, and with reference to the accompanying schematic drawings wherein.

Knitted structures consist of stitches which are arranged in rows and columns. Rows are generally called courses, and extend in the same direction as that of the knitting yarn, indicated at X in FIG. 1. The columns or wales extend in the perpendicular direction, indicated at Y in FIG. 1.

Figure 1:
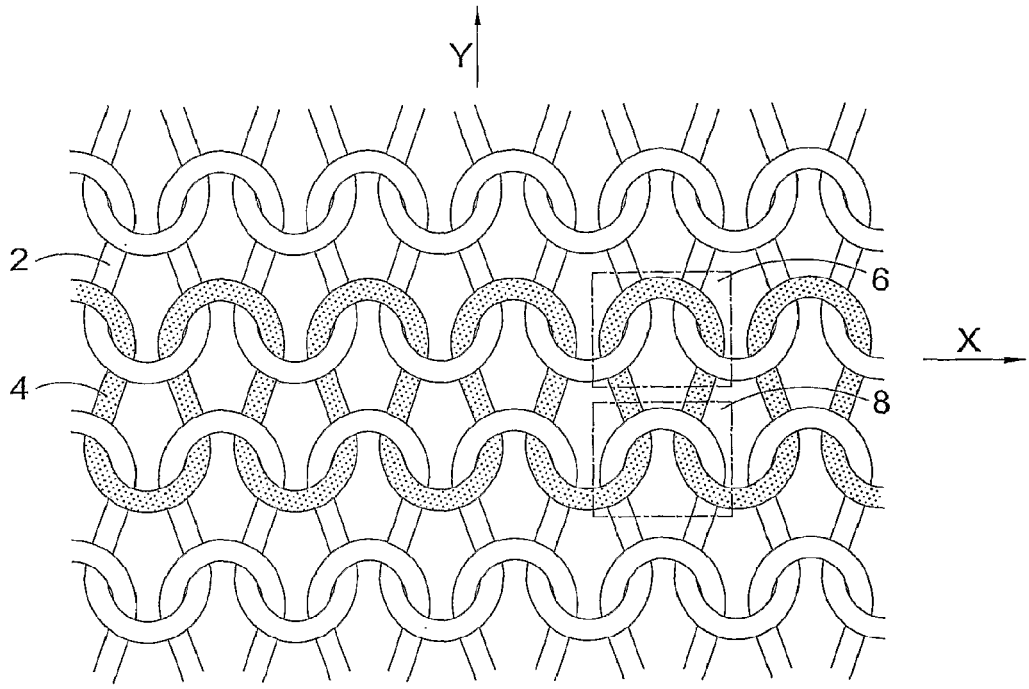
FIG. 1 is an enlarged view showing details of stitches in a knitted structure.

A knitted structure in a transducer according to the invention is made up of a number of non-conductive yarns 2 with an individual conductive yarn 4 extending along a single course as shown in FIG. 1. Successive courses of yarn are interlinked by loops forming stitches in which there are defined two specific binding areas 6 and 8. As shown in FIG. 1, the upper binding area 6 is at the distal end of a loop formed in the yarn 4, which extends through downwardly directed neighbouring loops in the adjacent non-conductive yarns 2. In the lower binding area 8 the arrangement is similar, with the downwardly extending loops being defined by the conductive yarn 4, held by the upwardly extending loop from the adjacent lower non-conductive yarn 2.

The fabric structure shown in FIG. 1 is relatively loose, and the yarns are substantially non-extensible. The yarns are though, fully flexible. As a consequence, when the structure is extended in the Y direction the structure will contract in the X direction. The result is engagement between the outer flanks of adjacent loops in each yarn, and particularly of those loops in the conductive yarn 4. This engagement creates an electrical short circuit of alternate lengths of yarn, thereby altering its electrical characteristics, and particularly the electrical resistance between the ends of the yarn on either side of the fabric structure. If the structure is then" extended in the direction X, then the effect is reversed with the loop flanks being withdrawn from one another and with that withdrawal, the removal of any short circuits created thereby. Any electrical current passing through the conductive yarn must then travel the full length of the yarn, whose effective resistance is thereby increased.

Figure 2:
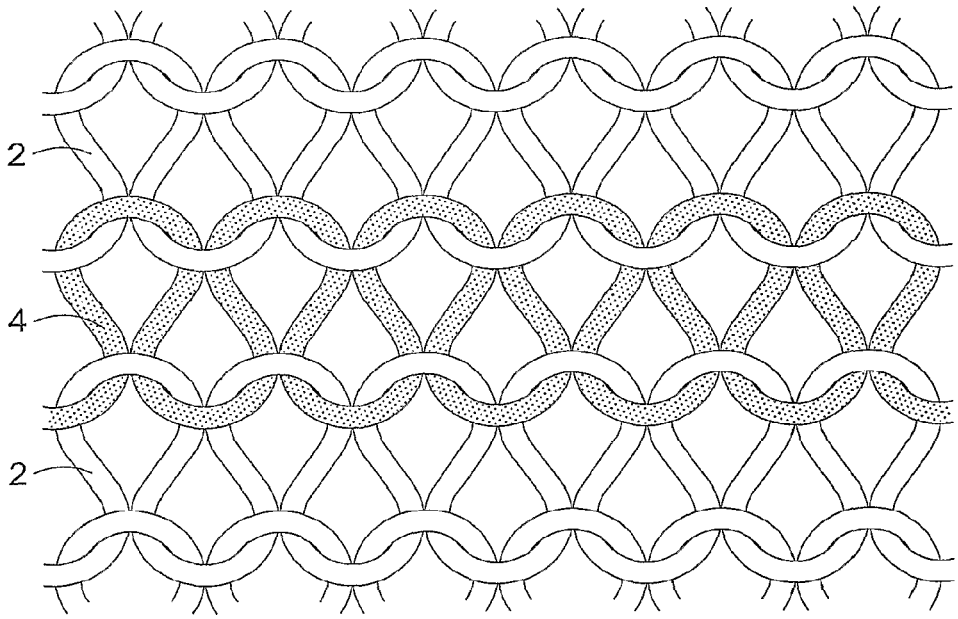
FIG. 2 is a view similar to that of FIG. 1 showing details of a knitted structure in which adjacent loops of a yarn in a course are touching.

A tightly knitted fabric of non-extensible yarns can be created with a relaxed structure of the kind illustrated in FIG. 2. As can be seen, successive loops in the yarn of each course of stitches are touching. If one (4) of the yarns shown was electrically conductive, then its electrical characteristics will be influenced by the contact and the points of contact between successive loops. Its measured resistance for example will be reduced relative to that of its full length by an amount determined by the location of the points of contact in the loops. In effect, there will be a short circuit across each loop.

Figure 3:
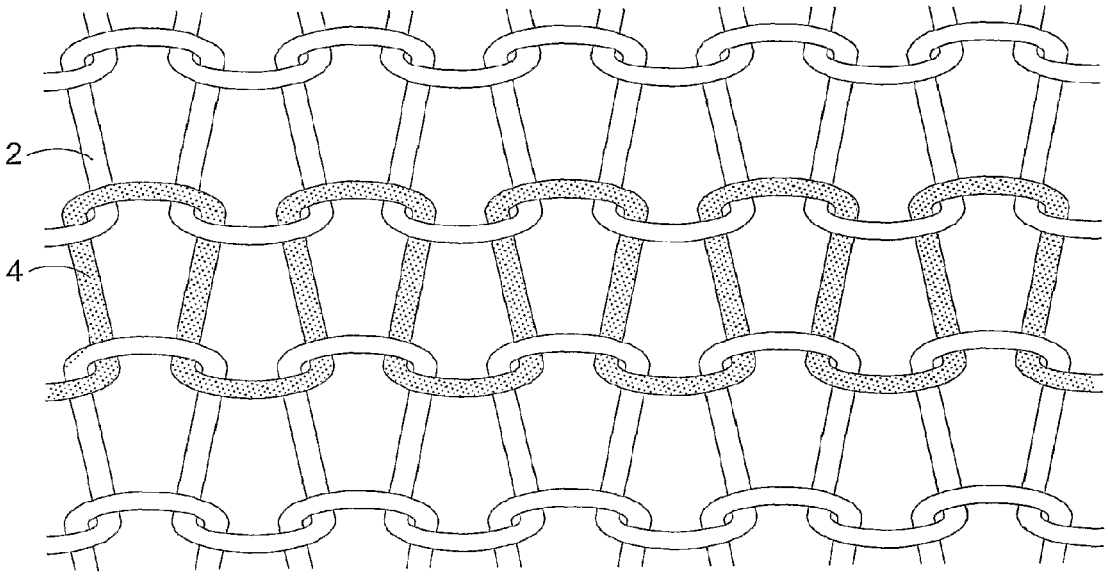
FIG. 3 is a view similar to that of FIG. 1 showing details of a knitted structure in which adjacent loops of a yarn in a course have been separated by stretching in the X direction.

If the fabric of FIG. 2 was extended in the course direction (X in FIG. 1), then each loop will be extended as shown in FIG. 3. The points of contact shown in FIG. 1 will disengage, and an electric current in the conductive yarn 4 must use its full length, including all the loops. Its measured electrical resistance will correspondingly increase, and by an amount that can be easily monitored. Extension of the fabric by a predetermined amount sufficient to disengage the contact points can therefore be registered. Other electrical characteristics, such as piezoelectric, capacitative or inductive can also be monitored to register different degrees of extension.

Figure 4:
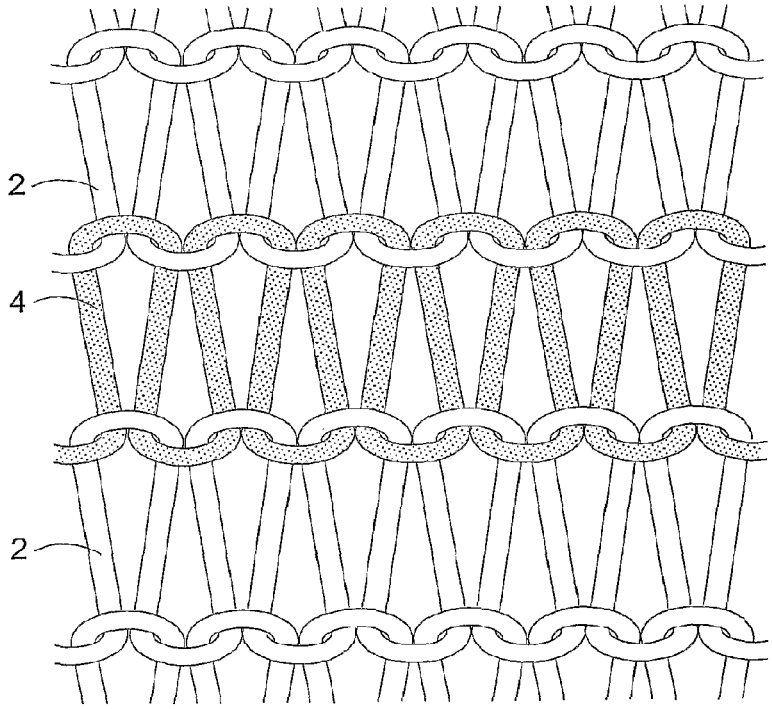
FIG. 4 is a view similar to that of FIG. 1 showing details of a knitted structure in which adjacent loops of a yarn in a course have been brought together by stretching in the Y direction.

If the fabric of FIG. 2 was extended in the wale direction (Y in FIG. 1), then each loop will be extended as shown in FIG. 4. As a consequence, the length of the conductive yarn 4 carrying current and therefore its measured resistance will be further reduced relative to that of its full length. The change will of course be progressive, enabling the amount of extension to be monitored, not just the passage beyond a predetermined amount. It will be appreciated that if the fabric of FIG. 2 was subject to extension in both the course and the wale direction, then extension in one of these directions will affect the monitoring of an electrical characteristic of the conductive yarn as a consequence of extension in the other. Monitoring circuitry can of course accommodate this, and in some circumstances monitor both extensions, for example by simultaneously monitoring different electrical characteristics of the yarn.

Figure 5:
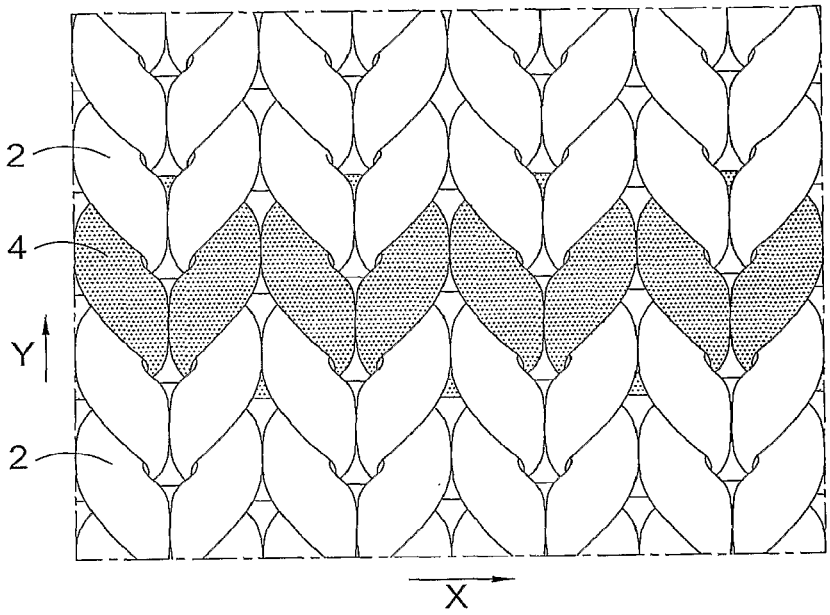
FIG. 5 is a similar enlarged view showing details of a knitted structure comprising elastomeric yarns.

A knitted structure embodying the present invention can be created using a conductive yarn in combination with low modulus non-conductive yarns such as single or double covered elastomeric yarns or monofilament or multifilament elastomeric yarn. In such a structure, because the low modulus yarn would be stretched during the knitting process, the knitted structure would naturally contract to bring adjacent flanks of the loops in respective stitches into intimate contact with each other. Such stitches are called jammed stitches, and a section from such a structure is illustrated in FIG. 5. This structure can effectively only be stretched or extended in the X direction. Thus, in its natural or relaxed state as illustrated, the electrical characteristic of an electro-conductive yarn 4 defining one of the courses in the structure will be that at which the juxtaposed flanks of adjacent loops are in close engagement, short circuiting alternate lengths of yarn as described above. Its electrical resistance for example will be reduced relative to that of the total length of the yarn without the short circuits. When the structure of FIG. 5 is stretched in the course direction X, the touching flanks are separated, and the overall resistance of the conductive yarn 4 between its ends is increased.

The knitted structure of FIG. 5 comprising the same low modulus or elastomeric yarns has uniform and predictable extension characteristics. As a consequence, when a single conductive yarn 4 is incorporated in the structure as described above, the point at which its electrical characteristic changes as a result of the separation of touching flanks can be accurately associated with a particular extension of the structure in the course direction X.

Transducers embodying the invention can be used in a number of applications where accurate monitoring identification of movement is required. This is of particular value in performance, sports and medical applications where it is needed to monitor respiration or physical movement around joints for example. It can though, also be useful to monitor cyclic testing of mechanical constructions.

Figure 6:
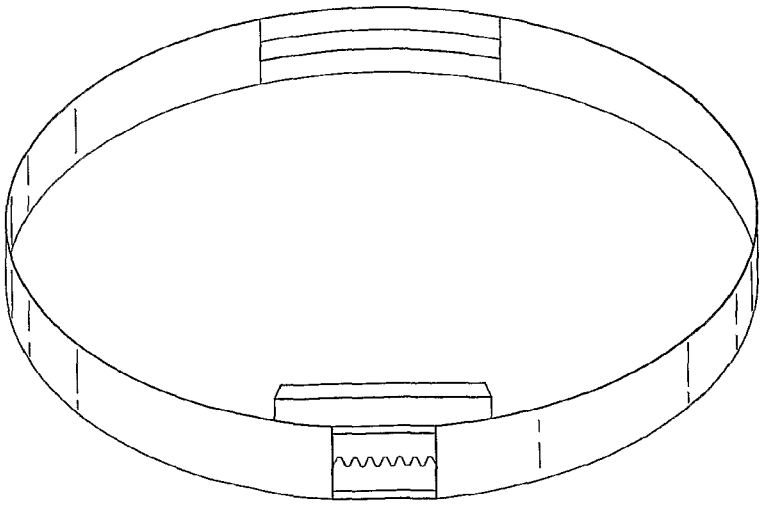
FIG. 6 shows how a knitted structure embodying the invention may be incorporated in a waistband or belt.

FIG. 6 illustrates a belt or strap incorporating a transducer 10 embodying the invention as shown. The transducer makes up the entire width of the belt, and must thereby accommodate any extension of the belt length. An adjustment mechanism 12 enables the belt to be fitted and adapted to the wearer such that it closely follows the respective body contours enabling extensions and contractions to be monitored.

Within the transducer 10, a single conductive yarn 4 extends within a structure comprising non-conductive yarns. At either lateral end of the transducer, the yarn 4 is connected to conductors 14 extending to a recorder box 16 which monitors changes in one or more electrical characteristics of the conductive yarn 4 within the transducer. The conductors 4 will be fixed in the body of the belt which, apart from the transducer 10, is substantially non-extensible. The control box 16 will be mounted on and slidable relative to the non-extensible belt sections. The recorder box 16 will include the requisite circuitry and power source such as a small battery, none of which is shown. It can also include a display panel to provide a visible indication of extensions and contractions of the belt as a whole. It can also be coupled to a remote recorder for monitoring these changes, either directly or through a wireless connection.

The invention has been described using a single conductive yarn in a knitted structure of non-conductive yarns. However, it will be appreciated that a plurality of conductive yarns may be used; either individually, or in parallel or in series.

Various different yarn materials may be used in knitted structures embodying the invention. Suitable non-conductive and non-extensible yarns (as per FIG. 1) are made from any natural and/or man-made fibres, such as cotton, wool, PE, PP, PA, Aramids etc. Preferred low modulus or elastomeric non-conductive yarns are monofilament or multifilament PU (Lycra, Spandex etc), single or double covered Lycra or Spandex. Suitable conductive yarns can be plain metal yarns such as stainless steel yarns, carbon yarns and all metal coated yarns. Suitable coated yarns consist of polyethylene multi-filaments, each coated with a nano layer of silver, copper, nickel or gold.

The invention claimed is:

1. An electronic transducer comprising a knitted structure of stitches arranged in courses and wales, and extendible in two dimensions defined by the courses and wales to distort the stitches, extension in the course dimension separating loops forming the stitches and extension in the wale dimension urging the loops together, wherein an electro-conductive yarn defines a plurality of separate and electrically isolated electro-conductive courses in the structure adjacent non-conductive courses defined by non-conductive yarns, in which, when unextended in either dimension successive loops of the stitches each respective one of the plurality of courses of electro-conductive yarn are in engagement, which yarn is adapted to be part of a circuit for providing an indication of an electrical characteristic of each respective one of the plurality of course of electro-conductive yarn.

2. A transducer according to claim 1 wherein the non-conductive yarns are low modulus yarns.

3. A transducer according to claim 2 wherein the non-conductive yarns are elastomeric yarns.

4. A transducer according to claim 2 wherein the non-conductive yarns are extended in the knitting process, whereby stitches in the knitted structure are jammed with successive loops of stitches including the electro-conductive yarn urged against one another.

5. A transducer according to claim 1 wherein the electrical characteristic of the electro-conductive yarn is resistance.

6. A transducer according to claim 1 wherein the electrical characteristic of the electro-conductive yarn is piezoelectric.

7. A transducer according to claim 1 wherein the electrical characteristic of the electro-conductive yarn is capacitive.

8. A transducer according to claim 1 wherein the electrical characteristic of the electro-conductive yarn is inductive.

9. A transducer according to claim 1 in combination with electrical circuitry for monitoring changes in said electrical characteristic.

10. A garment incorporating a transducer according to claim 1 as integral part thereof.

11. A garment according to claim 10 in the form of a belt.

12. An electronic transducer comprising a knitted structure of stitches arranged in courses and wales, and extendible in two dimensions defined by the courses and wales to distort the stitches, extension in the course dimension separating the loops forming the stitches and extension in the wale dimension urging the loops together, wherein an electro-conductive yarn consists of a single course in the structure adjacent courses of non-conductive yarn, in which, when unextended in either dimension successive loops of the stitches in said single electro-conductive course are in engagement with adjacent stitches, which yarn is adapted to be part of a circuit for providing an indication of an electrical characteristic of the single electro-conductive course.

* * * * *